United States Patent [19]

Liu et al.

[11] Patent Number: 4,961,249

[45] Date of Patent: Oct. 9, 1990

[54] CLIPBOARD STRUCTURE

[76] Inventors: David Liu; Jane Keo, both of No. 95, Kung Cheng Rd., Taichung, Taiwan

[21] Appl. No.: 466,932

[22] Filed: Jan. 18, 1990

[51] Int. Cl.[5] ..... B42F 1/00

[52] U.S. Cl. ..... 24/67.3; 24/67.7; 24/500

[58] Field of Search ..... 24/67.3, 67.5, 67.7, 24/67.11, 500, 509, 510; 281/45

[56] References Cited

U.S. PATENT DOCUMENTS

| | | | |
|---|---|---|---|
| 598,368 | 2/1898 | Griffin | 24/67.3 |
| 658,756 | 10/1900 | Buckler | 24/67.5 |
| 1,069,210 | 8/1913 | Ward | 24/67.11 |
| 1,359,243 | 11/1920 | Flournog, Jr. | 24/67.11 |
| 2,453,507 | 11/1948 | Harper | 24/67.11 |
| 4,375,296 | 3/1983 | Chang | 24/67.3 X |

*Primary Examiner*—James R. Brittain

*Attorney, Agent, or Firm*—Bacon & Thomas

[57] ABSTRACT

A clipboard structure includes a board having a seat formed on one end of an upper surface. A recess is formed in an outer end of the seat. A clamping element has two legs disposed in the recess. A spring element has two free ends fixed to the legs of the clamping element. The spring element can be easily assembled in the recess of the seat. The spring element biases the legs of the clamping element so that a front end of the clamping element is forced to abut against the board.

2 Claims, 3 Drawing Sheets

CLIPBOARD STRUCTURE

BACKGROUND OF THE INVENTION

The present invention relates to a clipboard, and more particularly to a clipboard structure which can be easily assembled.

One type of clipboard is disclosed in Walter M. Gorman, U.S. Pat. No. 3,828,402 issued Aug. 13, 1974, for "Device for Releasable Gripping Article". In that patent, screws or rivets are required to fix the member 40 on a support member 32. The screws or rivets protrude from a lower surface of the support member 32, the screws may hurt table surfaces.

Another type of clipboard is disclosed in Shih-Ho Chang, U.S. Pat. No. 4,763,389 issued Aug. 16, 1988, for "Clipboard Structure". In that clipboard, a supporting base 30 is disposed below a board 20. The supporting base 30 makes the board 20 an uneven lower surface.

The present invention has arisen to mitigate and/or obviate the afore-described disadvantages of the conventional clipboards.

SUMMARY OF THE INVENTION

The primary objective of the present invention is to provide a clipboard structure which can be assembled easily.

Another objective of the present invention is to provide a clipboard structure which has a smooth and flat lower surface.

In accordance with one aspect of the invention, there is provided a clipboard structure which includes a board having a seat formed on one end of an upper surface. A recess is formed in an outer end of the seat. A rib is laterally formed in an upper surface of the recess. Two lugs are formed on a lower end of an opening of the recess. A clamping element is C-shaped with two legs disposed in the recess. A spring element is U-shaped with two free ends fixed to the legs of the clamping element. The spring element is disposed in the recess of the seat. The front end of the spring element contacts an inner end of the recess and is engaged with a rear end of the rib. The spring element biases the legs of the clamping element so that a front end of the clamping element is forced to abut against the board. The lug limits a rearward movement of the legs of the clamping element.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
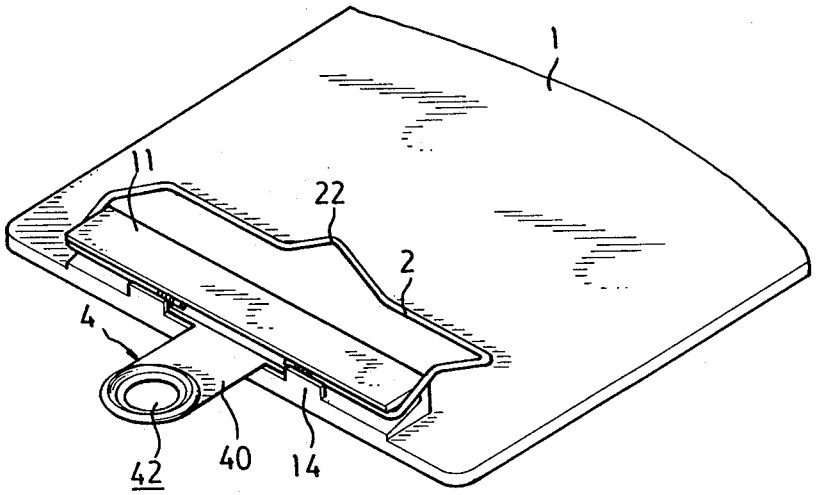
FIG. 1 is a perspective view of a clipboard in accordance with the present invention.
Figure 2:
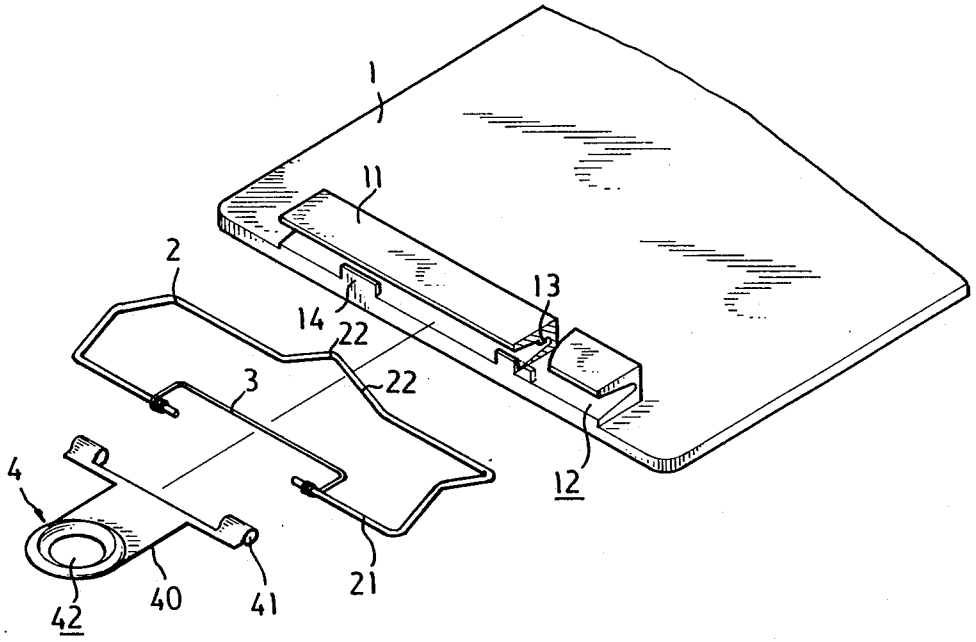
FIG. 2 is an exploded view of the clipboard.

Referring to the drawings and initially to FIGS. 1 and 2, the clipboard in accordance with the present invention comprises generally a board 1 having a seat 11 formed on one end of an upper surface thereof; a clamping element 2, one end thereof is disposed in the seat 11 of the board 1; a spring element 3 being coupled on one end of the clamping element 2 and being disposed in the seat 11 of the board 1; and a retaining element 4 retaining the spring element 3 in the seat 11 of the board 1.

The seat 11 is integrally formed on one end of the upper surface of the board 1 and laterally runs on a middle portion of the board 1. A recess 12 is formed in an outer surface of the seat 11 and runs all the way through the seat 11. A rib 13 is laterally formed in an upper surface of the recess 12 and has a length shorter than that of the seat 11. A pair of lugs 14 are vertically formed on the outer end of the seat 11 and located on the opening of the recess 12.

The clamping element 2 is substantially C-shaped with two legs 21 thereof being disposed in the recess 12 of the seat 11 of the board 1 so that the clamping element 2 is substantially rotatable about a longitudinal axis of the legs 21. The width of the clamping element 2 is substantially equal to that of the seat 11 so that the two sides of the clamping element 2 contact the lateral sides of the seat 11. A rise portion 22 is formed on a front middle portion of the clamping element 2. The spring element 3 is substantially U-shaped and extends inwards of the clamping element 2. The free ends of the spring element 3 are fixed to the respective free ends of the legs 21 of the clamping element 2. The spring element 3 is inserted into the recess 12 of the seat 11 of the board 1. The front end of the spring element 3 contacts the inner end of the recess 12 and engages the rear end of the rib 13. The spring element 3 biases the legs 21 of the clamping element 2 so that the front end of the clamping element 2 is forced to abut against the board 1. The front end of the clamping element 2 can be pulled up by the rise portion 22 thereof. The lugs 14 limit a rear movement of the legs 21 of the clamping element 2 and the spring element 3.

The retaining element 4 comprises a base portion 40 having a hole 42 formed in a rear end thereof, and two tube-shaped elements 41 formed on a front end of the base portion 40. The coupling portions between the free ends of the legs 21 of the clamping element 2 and the spring element 3 are received in the respective tube-shaped elements 41. The tube-shaped elements 41 are forced over the lugs 14 into the recess 12 of the seat 11 of the board 1 so that the free ends of the clamping element 2 and the spring element 3 are further stably retained within the recess 12 of the seat 11.

Figure 3:
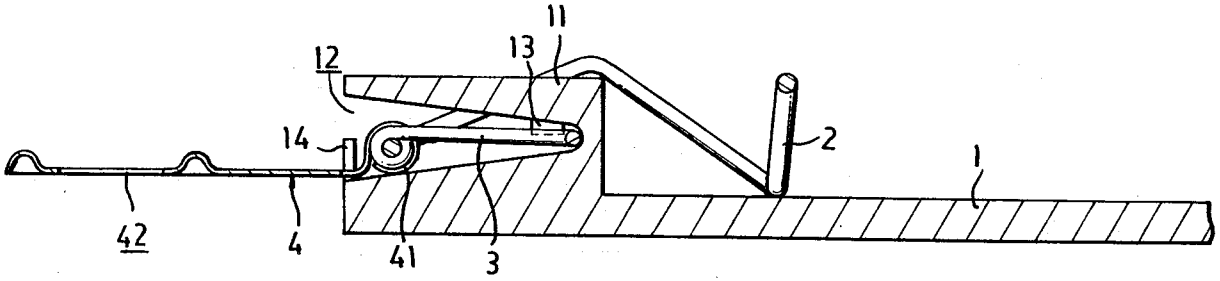
FIG. 3 is a longitudinal cross sectional view of the clipboard.

Referring next to FIG. 3, the spring element 3 is retained in the recess 12 by the engagement between the front end of the spring element 3 and rib 13, and is further retained within the recess 12 by the retaining element 4. The lugs 14 limit a rearward movement of the tube-shaped portions 41 of the retaining element 4 so that the tube-shaped portions 41 of the retaining element 4 are stably retained within the recess 12 of the seat 11.

Accordingly, the present invention has the following advantages:

(a) The clamping element 2 and the spring element 3 can be easily assembled in the seat 11 of the board 1 without using additional tools.

(b) The lower surface of the board 1 is flat and smooth.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A clipboard structure comprising a board with a seat formed on one end of an upper surface thereof, a recess being formed in an outer end of said seat and extending through said seat, a downwardly extending rib being laterally formed in an upper surface of a wall defining said recess, and at least one upwardly extending lug formed on an opening of said recess; a clamping element being substantially C-shaped with two legs thereof disposed in said recess; a spring element being substantially U-shaped with two free ends thereof respectively fixed to said legs of said clamping element, said spring element being disposed in said recess of said seat, a front end of said spring element contacting an inner end of said recess and being engaged with a rear end of said rib; said spring element biasing said legs of said clamping element so that a front end of said clamping element is forced to abut against said board; and said lug limiting a rearward movement of said legs of said clamping element.

2. A clipboard structure according to claim 1, wherein a retaining element includes a base portion and two tube-shaped elements formed on a front end of said base portion; said legs of said clamping element are respectively received within said tube-shaped portions of said retaining element; and said tube-shaped elements are retained within said recess by said lug.

* * * * *